United States Patent [19]

Desjardins

[11] Patent Number: 5,029,792

[45] Date of Patent: Jul. 9, 1991

[54] ACCESSORY HOLDER FOR VACUUM CLEANING SYSTEM

[76] Inventor: Albeo J. Desjardins, 49 Tidewater Farms Rd., Greenland, N.H. 03840

[21] Appl. No.: 430,802

[22] Filed: Nov. 2, 1989

[51] Int. Cl.[5] ..... A47F 5/00

[52] U.S. Cl. ..... 248/309.1; 211/70.6; 248/79

[58] Field of Search ..... 248/309.1, 314, 310, 248/79, 75; 211/70.6, 187; 312/242

[56] References Cited

U.S. PATENT DOCUMENTS

| | | | |
|---|---|---|---|
| 4,253,716 | 3/1981 | Turner, Jr. | 248/79 X |
| 4,294,498 | 10/1981 | Van Luit | 312/242 X |
| 4,346,863 | 8/1982 | Zeitrager et al. | 248/75 |
| 4,474,415 | 10/1984 | Perri | 312/242 |
| 4,614,374 | 9/1986 | Lannert et al. | 312/242 |
| 4,681,380 | 7/1987 | Carlin | 312/242 |

*Primary Examiner*—Ramon O. Ramirez
*Attorney, Agent, or Firm*—Cesari & McKenna

[57] ABSTRACT

An accessory holder for storing miscellaneous accessories for a vacuum cleaning system comprises a container containing a J-shaped hook for holding a coiled hose, clips for holding various extension wands, and compartments for storage of other accessories. It is preferable that the container be dimensioned so that it can be recessed into a wall and fit snugly between the wall studs being retained there by frictional engagement with the studs.

9 Claims, 1 Drawing Sheet

ACCESSORY HOLDER FOR VACUUM CLEANING SYSTEM

FIELD OF THE INVENTION

This invention relates generally to an accessory holder for storing hoses, extension wands, and other parts for a central vacuum system. More particularly, it relates to such a holder which can be inserted behind a wall.

BACKGROUND OF THE INVENTION

The invention of the vacuum cleaner, which takes up dust, dirt, or other small debris by suction, has no doubt made cleaning of carpets, floors, upholstery and the like much easier and much faster.

However, pushing a vacuum cleaner around the surface to be cleaned, especially from one room to another, can still be a very demanding task for young children and infirm or older people because of the weight of the machine and the friction between the machine and the surface to be cleaned. Actually, the cleaning efficiency of even a strong person can be greatly improved if the need to push around the vacuum cleaner can be eliminated.

Another major drawback of a vacuum cleaner is that proper routine maintenance of the cleaning machine, such as replacement of a worn belt, is usually required and that can be both tedious and time consuming.

To avoid the aforementioned problems associated with mobile vacuum cleaners, people have resorted to central vacuum cleaning systems. A standard central vacuum cleaning system basically comprises a central electrical vacuum pump, a central dust collecting tank with filters, duct-work connected to the pump and the tank with at least one outlet in each room. By plugging a hose fitted with suitable accessories, into the outlet in each room, all the carpets or floors of a house or building can be cleaned without the need of pushing a machine around from one room to another.

For a central vacuum cleaning system to perform properly, accessories such as flexible hoses, extension wands, rug and upholstery nozzles, brushes, and the like are required. For convenience, it is advisable to have all these accessories stored in a single container or holder so that they can be retrieved readily. Also, to save space, it is highly desirable that this container or holder be of the wall inset type.

SUMMARY OF THE INVENTION

Accordingly, it is the general object of the present invention to provide an accessory holder for a central vacuum cleaning system.

It is another object of the present invention to provide such an accessory holder which can be recessed into the wall of a closet or other suitable area so that no extra space is needed for storing accessories.

It is a further object of the present invention to provide such a holder whose dimensions allow it to fit snugly between two conventionally spaced wall studs, being retained in place by frictional engagement with the studs, so that nails, screws, glue, or the like are not required. Such releasable engagement also makes removal of the holder from the wall, if desired, a very simple task.

These and other objects will become more apparent hereinafter.

The invention accordingly comprises the features of construction, combination of elements and arrangement of parts which will be exemplified in the following detailed description, and the scope of the invention will be indicated in the claims.

Briefly, the preferred embodiment of the present invention comprises a container of rectangular parallelepiped shape which is completely closed except for an opening in the front wall of the container. This opening provides an access for the user to place in and retrieve from the container all the accessories of a typical central vacuum cleaning system.

Adjustable divider panels, extending between the front and rear walls of the container, form compartments or bins at the bottom of the container. Miscellaneous accessories for the central vacuum system such as the rug nozzle or the brush can be stored conveniently in these compartments.

A J-shaped hook and a plurality of half-tubes that form C-clips are mounted to the inner surface of the rear wall, preferably at upper portions thereon, for holding a coiled flexible hose and various extension wands, respectively.

It is preferable that the container have such dimensions that it can fit snugly between two conventionally spaced wall studs, thereby eliminating the need for any extra floor space for placement of the holder and the accessories therein.

It is also desirable that the container be slightly compliant or resilient and that its sides have a relatively high coefficient of friction that it can be held firmly between two wall studs solely by frictional engagement with the studs.

BRIEF DESCRIPTION OF THE DRAWING

The above and further advantages of the present invention may be better understood by referring to the following description in conjunction with the accompanying sole drawing, which is a isometric view of an accessory holder for a vacuum cleaning system made in accordance with this invention.

DETAILED DESCRIPTION OF ILLUSTRATIVE EMBODIMENTS

Figure 1:
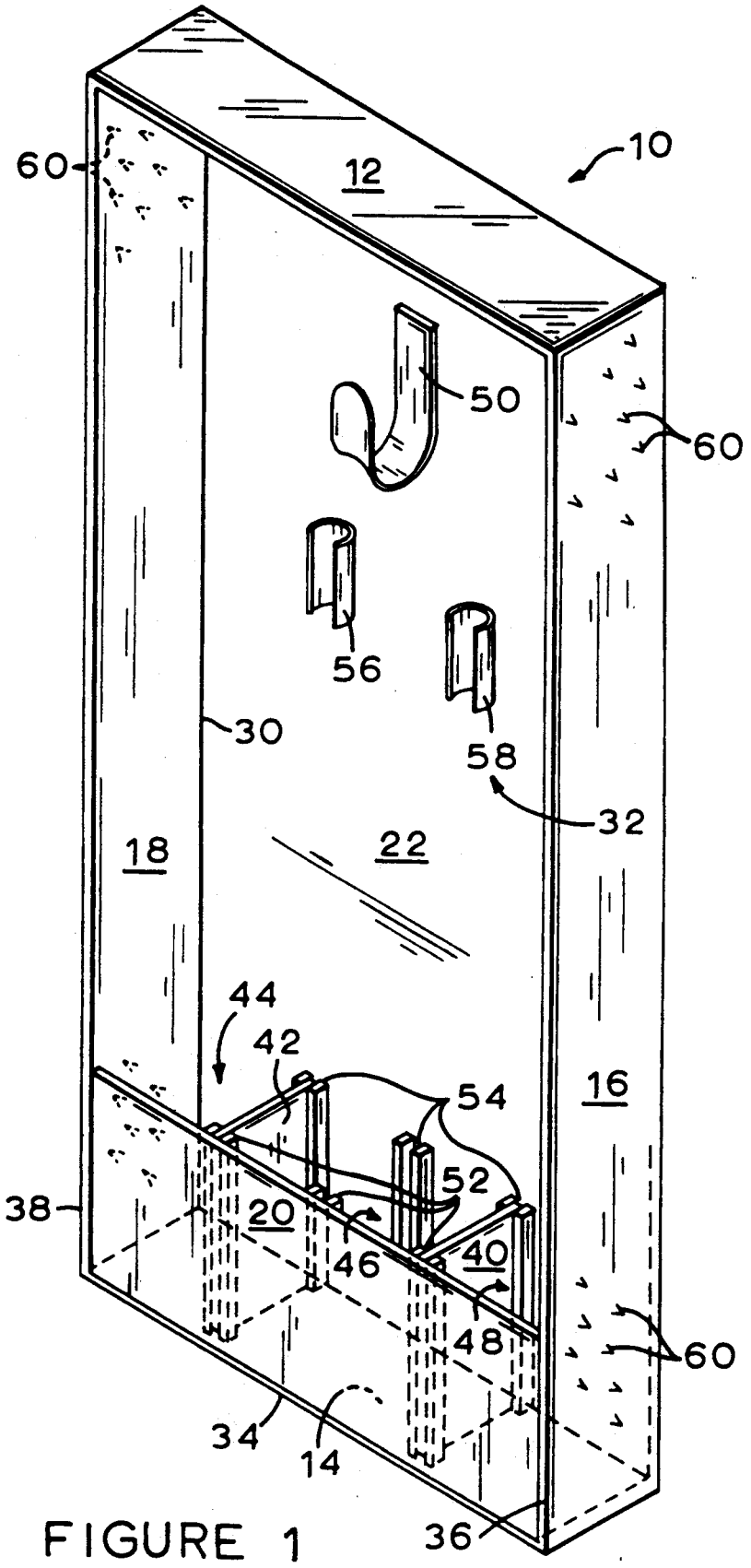

As used hereinafter, the terms "top" and "bottom", "upper" and "lower", and "rear" and "front", respectively, are used to denote relative direction solely with reference to the accompanying drawing.

Referring now to the drawing, my accessory holder includes a container 10 having six rectangular walls or panels, i.e. a top panel 12, a bottom panel 14, two side panels 16, 18, a front panel 20, and a rear panel 22.

The top panel 12 and the bottom panel 14, which parallel each other have identical dimensions. So do the two side panels 16, 18 which also parallel each other. In contrast, the front panel 20, which is in parallelism with the rear panel 22, has a height substantially smaller than the height of the rear panel 22 although the widths of these two panels 20, 22 are nonetheless the same. This forms an opening 32 in the front of the container 10.

As illustrated in the holder embodiment, the container 10 contains two divider panels 40, 42. Each divider panel 40, 42 has a height similar to that of the front panel 20 and a width or depth similar to that of the top panel 12 or bottom panel 14. Each such panel 40, 42 is placed in the container in such a way that it is generally in parallelism with side panels 16, 18 with its bottom edge and two side edges against bottom panel 14, front panel 20, and rear panel 22, respectively. The divider panels 40, 42 thus form three compartments 44, 46, 48 at the bottom of the container 10 which can be used to store miscellaneous accessories such as rug nozzles, brushes, or the like.

While all the panels 12, 14, 16, 18, 20, 22, 40, and 42 can be connected to each other by any suitable securing means such as glue, nails, screws, or the like, it is preferred that divider panels 40, 42 be releasably retained such as by groove engagement with the front and rear panels 20, 22. In the illustrated holder, several pairs of vertical slots 52, 54 are formed in the container front and rear panels for slidably retaining the divider panels 40, 42. By mounting the divider panels 40, 42 to the different pairs of slots 52, 54, the dimensions of the compartments 44, 46, 48 can be adjusted by the user. If desired, the container 10 can even be injection molded using a suitable plastic, e.g. high density polyethylene. In this event, the front panel 20 could be molded separately from the remainder of the container 10 and held in place by slots similar to slots 52, 54 formed in the side panels 16, 18.

The flexible hoses and extension wands constitute the most bulky accessories of a typical central vacuum cleaning system. As shown in the drawing, a J-shaped hook 50, and two resilient metal or plastic half tubes 56, 58 are mounted to the inner surface of rear panel 50, preferably in the upper portion thereof. Each half tube 56, 58 has a semi-circular cross section with a diameter slightly smaller than that of a typical extension wand. It thus forms a C-clip for releasably holding an extension wand. The J-shaped hook 50, which can also be made of metal or plastic, is provided for holding a flexible hose after it is coiled.

In order that the accessory holder can be recessed into a wall, it is desirable that the width of the container 10 approximate the distance between two wall studs, typically 14.5 inches for standard 2x4 studs spaced 16 inches on center. Also, the thickness or depth of the container 10 should approximate the width of the stud, e.g. 3.5 inches for a 2x4 stud. The height of the container 10 is more or less optional. A container 10 of this size can then be inserted between a pair of studs in a closet, or any other suitable area after cutting an approximate hole in the wall. Fitting snugly between the studs, the holder will be held in place simply by frictional engagement with the studs. In this connection, it should be pointed out that while the container 10 can be made of any suitable material, it be somewhat compliant or resilient and that at least its side panels 16, 18 have a relatively high coefficient of friction. For example, those panels 16, 18 may be formed with exterior texturing or bosses as shown at 60. These factors will ensure firm engagement of the holder between a pair of studs. Also, with the thickness of the container 10 approximating the width of the stud, the front panel 14 of the container 10 is flush with the surface of the surrounding wall area.

It should be pointed out that while the holder and its use is described above solely in connection with storage of accessories for central vacuum cleaning systems, the same holder can also be used for storing miscellaneous accessories associated with conventional vacuum cleaners for obvious reasons.

The foregoing disclosure and description has been limited to a specific embodiment of the present invention. It will be apparent, however, that variations and modifications in the size, shape, materials and details of the illustrated construction may be made with the attainment of some or all of the advantages of the invention without departing from the spirit thereof. Therefore, it is the object of the appended claims to cover all such variations and modifications as come within the true spirit and scope of the invention.

What is claimed is:

1. An accessory holder for storing in a space between adjacent wall studs accessories for a vacuum cleaner, said holder comprising:

A. a resilient box including a top panel, a bottom panel, two side panels, and a rear panel connected to form the top, bottom, sides and rear of said box;

B. hose holding means mounted to the inner surface of said rear panel, for holding a vacuum cleaner hose in a coiled manner; and C. wand holding means for holding vacuum cleaner wands, said wand holding means being mounted to the inner surface of said rear panel in a position which holds the wands behind a coiled hose held on said hose holding means;

said box being slightly wider than the distance between adjacent wall studs and compressible such that the distance between the two side panels decreases, wherein said box is installed between the studs by compressing the box, inserting the box in between the studs and releasing the box, the edges of the installed box being even with a wall associated with the wall studs.

2. The accessory holder of claim 1, wherein said hose holding means is a large J-shaped hook.

3. The accessory holder of claim 1, wherein said wand holding means is at least one C-shaped hook.

4. The accessory holder of claim 1, wherein said box further includes a front panel which is shorter than said rear panel, said front panel attaching to said side panels and said bottom panel to form a compartment at the bottom of said box for storing bulky accessories.

5. The accessory holder of claim 4, wherein said box still further includes dividers located between said front panel and said rear panel, said dividers dividing said compartment into smaller compartments.

6. An accessory holder for storing in a space between adjacent wall studs accessories for a vacuum cleaner, said holder comprising:

A. a resilient box including a top panel, a bottom panel, two side panels, and a rear panel connected to form the top, bottom, sides and rear of said box, and a front panel which is shorter than said rear panel connected to said side panels and said bottom panel to form at the bottom of said box a compartment for storing bulky accessories;

B. hose holding means mounted to the inner surface of said rear panel, for holding a vacuum cleaner hose in a coiled manner; and C. wand holding means for holding vacuum cleaner wands, said wand holding means being mounted to the inner surface of said rear panel in a position which holds the wands behind a coiled hose held on said hose holding means;

said box being slightly wider than the distance between adjacent wall studs and compressible such that the distance between the two side panels decreases, whereby said box is installed between the studs by compressing the box, inserting the box in between the studs and releasing the box.

7. The accessory holder of claim 6, wherein said container further includes dividers located between said front panel and said rear panel, said dividers dividing said compartment into smaller compartments.

8. The accessory holder of claim 6, wherein said hose holding means is a large J-shaped hook.

9. The accessory holder of claim 6, wherein said wand holding means is at least one C-shaped hook.

* * * * *